US005467801A

United States Patent [19]

Kaneda et al.

[11] Patent Number: 5,467,801

[45] Date of Patent: Nov. 21, 1995

[54] WARP YARN LEVELING MOTION INCORPORATED WITH A LOOM STOP TIMING JUDGING DEVICE

[75] Inventors: Kazuo Kaneda, Sagamihara; Masayuki Ushiro, Tanashi, both of Japan

[73] Assignee: Nissan Texsys Co., Ltd., Tokyo, Japan

[21] Appl. No.: 228,424

[22] Filed: Apr. 15, 1994

[30] Foreign Application Priority Data

Apr. 17, 1993 [JP] Japan ..... 5-113765

[51] Int. Cl.[6] ..... D03D 51/00; D03C 13/00

[52] U.S. Cl. ..... 139/1 E; 139/116.2; 139/79

[58] Field of Search ..... 139/1 E, 35, 1 R, 139/116.2, 55.1, 79, 75

[56] References Cited

U.S. PATENT DOCUMENTS

| | | | |
|---|---|---|---|
| 4,534,385 | 8/1985 | Froment et al. | 139/79 |
| 5,090,452 | 2/1992 | Benelli | 139/116.2 X |
| 5,228,480 | 7/1993 | Tamura | 139/1 E |

FOREIGN PATENT DOCUMENTS

| | | | |
|---|---|---|---|
| 3-68136 | 10/1991 | Japan . | |
| 4-257348 | 9/1992 | Japan . | |
| 4-343733 | 11/1992 | Japan | 139/1 E |
| 5-78953 | 3/1993 | Japan . | |

*Primary Examiner*—Andy Falik
*Attorney, Agent, or Firm*—Foley & Lardner

[57] ABSTRACT

A loom equipped with a leveling motion incorporated with a cam-operated type shedding motion. The loom is provided with a control unit to control a variety of operations of the loom. Upon stopping of the loom weaving operation in response to a loom stop signal, the control unit judges that a loom stop time required for recovering a failed condition is longer or shorter than a predetermined time in accordance with the type of the loom stop signal which is different depending upon the cause for which the loom weaving operation is stopped. If the result of the judgement is that the loom stop time is longer than the predetermined time, the leveling motion is operated to level warp yarns at the level near a warp line, thereby loosening the tension applied to the warp yarns.

10 Claims, 7 Drawing Sheets

WARP YARN LEVELING MOTION INCORPORATED WITH A LOOM STOP TIMING JUDGING DEVICE

BACKGROUND OF THE INVENTION

1. Field of the Invention

This invention relates to improvements in a loom equipped with a harness leveling motion, and more particularly to the improvements to prevent formation of a weaving defect such as filling bar in a woven cloth while obtaining a high operational efficiency of the loom.

2. Description of the Prior Art

It is well known that looms are equipped with a leveling motion to level warp yarns generally at the level of a warp line. The leveling motion incorporated with a cam-operated type shedding motion is disclosed, for example, in Japanese Patent Publication No. 3-68136 and Japanese Patent Provisional Publication No. 5-78953. The former Publication describes a mechanism accomplishing the following process: Upon detecting a breakage of a warp yarn by a warp yarn dropper, the weaving operation of a loom is stopped, and simultaneously the leveling motion connected with a heald frame is operated in response to a signal representative of this warp yarn breakage detection thereby leveling the warp yarns at the level of the warp line. After reparing the warp yarn breakage, the leveling motion is put into its inoperative condition to release its leveling action, and then the loom weaving operation is restarted.

The latter publication describes a mechanism accomplishing the following process: In the event that the weaving operation of a loom is stopped upon breakage of a warp yarn and failure in weft picking, the leveling motion is automatically operated to accomplish a so-called closed leveling in which all heald frames are leveled at an intermediate level of a shedding distance.

Thus, in the above-mentioned processes, the leveling motion is operated to change warp yarns from their open shed condition to their closed shed condition thereby preventing the warp yarns from being unduly stretched during the loom weaving operation stopping. This is because the cam-operated type shedding motion is such arranged that the amount (distance) of shedding is restricted by cams, so that the warp yarns cannot be readily put into their closed shed condition. It will be understood that leveling warp yarns can effectively prevent formation of filling bar in a woven cloth owing to the unduly stretched warp yarns under a long stopping time of loom weaving operation.

In recent years, it has been proposed that when a failure in were picking occurs in a loom, the weaving operation of the loom is stopped, and then a faulty weft yarn removing device is operated to automatically remove the faulty weft yarn from a woven cloth; and thereafter the loom weaving operation is automatically restarted. This is disclosed, for example, in Japanese Patent Provisional Publication No. 4-257348. In case of using the cam-operated type shedding motion on the premise that an automatic restarting of the loom weaving operation is made, when the failure in weft picking occurs, the faulty weft yarn removing device is first operated to automatically remove the faulty weft yarn from the were yarn path. Completion of this automatic faulty weft yarn removing operation provides no problem. However, if this faulty weft yarn removing operation fails, the faulty were yarn must be manually removed by an operator under a condition where the faulty weft yarn is exposed at the cloth fell while the warp yarns are kept in the maximum open shed state in order to facilitate the operator's manual removal operation. Usually a long time is required until the operator comes to the loom and completes a removing and repairing operation for the faulty weft yarn. During this long time, the warp yarns are being kept stretched thereby causing a filling bar in the woven cloth at the restarting of the loom weaving operation.

SUMMARY OF THE INVENTION

It is an object of the present invention to provide an improved loom provided with a leveling motion incorporated with a shedding motion, which can effectively overcome drawbacks encountered in conventional looms provided with the leveling motion.

Another object of the present invention is to provide an improved loom provided with a leveling motion incorporated with a shedding motion, in which a weaving defect such as filling bar can be effectively prevented from being formed in a woven cloth while maitaining a high operational efficiency of the loom even if the weaving operation of the loom is stopped owing to any abnormality.

A further object of the present invention is to provide an improved loom provided with a leveling motion incorporated with a shedding motion, in which warp yarns can be effectively prevented from being unduly stretched by leveling the warp yarns upon operating the leveling motion, on a judgment that a considerably long time will be required for recovering an abnormality.

A loom of the present invention comprises a shedding motion. A leveling motion is incorporated with the shedding motion to level warp yarns, when operated. A device is provided to generate a loom stop signal to stop a weaving operation of the loom. A device is provided to operate the leveling motion in response to the loom stop signal. A device is provided to judge that a loom stop time is longer or shorter than a predetermined time in accordance with the loom stop signal. The loom stop time is required from a first time at which the loom weaving operation is stopped to a second time at which the loom weaving operation is restarted. A device is provided to operate the leveling motion in response to a judgment of the judging device that the loom stop time is longer than the predetermined time.

With this loom, in the event that the loom weaving operation is stopped owing to a cause such as breakage of a warp yarn, a selvage yarn or a weft end treatment yarn, it is judged that a considerable long time is required to manually recover a failed condition by an operator, and therefore the leveling motion is operated immediately thereby softening a tension applied to the warp yarns thus preventing the formation of filling bar in the woven cloth. However, in the event that the loom weaving operation is stopped owing to another cause such as a failure in were picking, it is judged that a relatively short time is sufficient to recover the failure under operation of an automatic faulty weft yarn removing device, and therefore the faulty weft yarn is removed to normalize the loom weaving operation without operating the leveling motion. Thus, according to the loom of the present invention, the operational effeciency of the loom can be maintained high without causing weaving defects in the woven cloth.

DETAILED DESCRIPTION OF THE INVENTION

Figure 1:
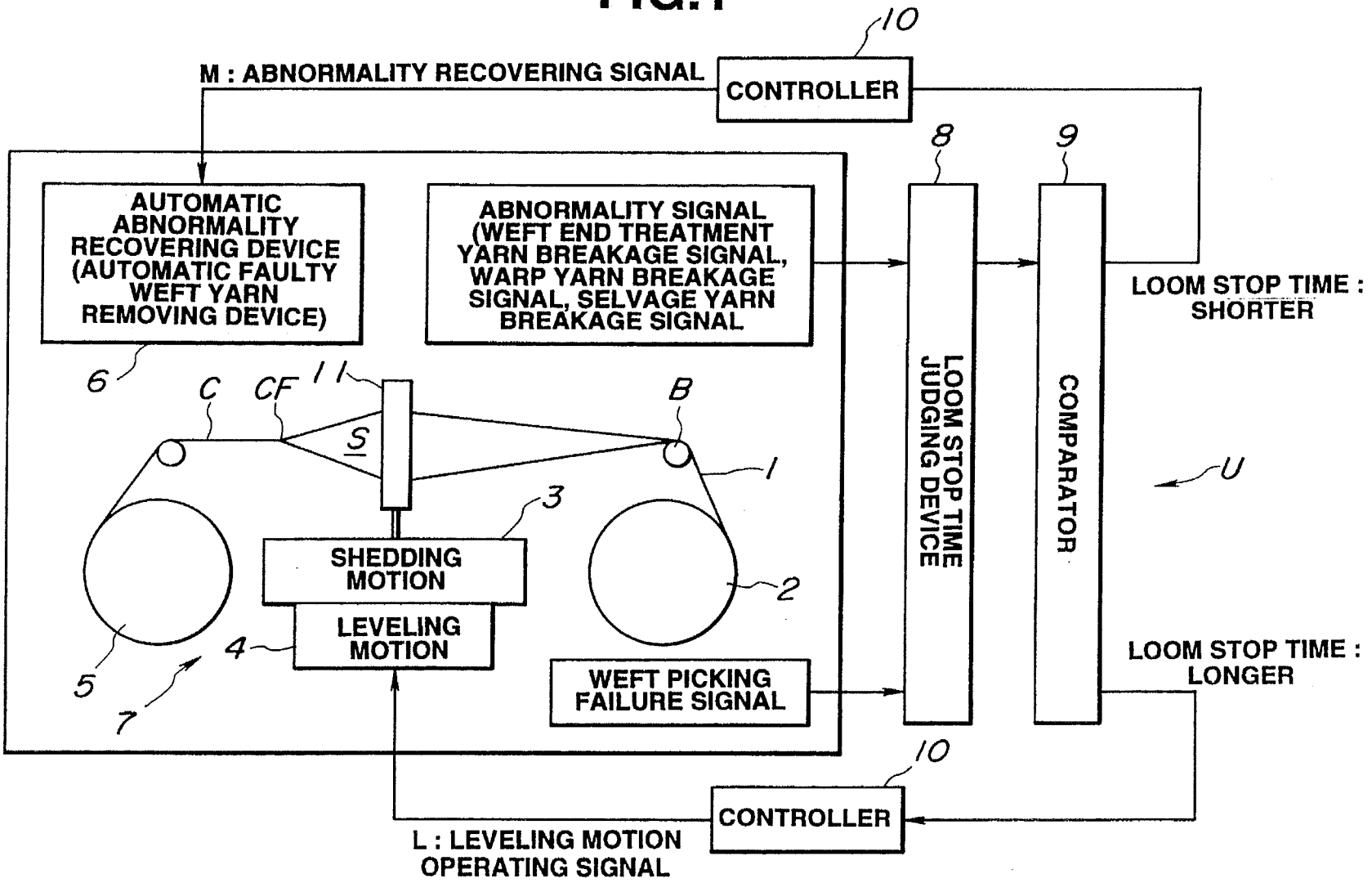
FIG. 1 is a block diagram of an embodiment of a loom in accordance with the present invention.

Referring now to FIGS. 1 to 7, more specifically FIG. 1 of the drawings, an embodiment of a loom according to the present invention is illustrated by the reference character 7. In this loom 7, warp yarns 1 are wound on and extend from a warp beam 2 through a shedding motion 3 to the cloth fell CF of a woven cloth C. The woven cloth C is wound on a cloth roller 5. The shedding motion 3 is of the cam-operated type which will be discussed in detail below. The loom 7 is provided with an automatic abnormality recovering device 6 such as an automatic faulty weft yarn removing device which is well known per se as disclosed in Japanese Patent Provisional Publication No. 4-257348. The automatic faulty weft yarn removing device 6 is constructed and arranged to automatically remove a faulty weft yarn such as a mispicked weft yarn from the path of the weft yarn when a failure in weft picking occurs.

The loom 7 is further provided with a variety of sensors (not shown) which are respectively adapted to generate abnormality signals such as a warp yarn breakage signal when a warp yarn is broken or cut, a selvage yarn breakage signal when a yarn for forming a selvage structure (not shown) of the woven cloth C is broken or cut, a weft end treatment yarn breakage signal when a yarn for forming a trimmed selvage structure (not shown) of the woven cloth C is broken or cut, and a weft picking failure signal when a weft picking fails. When each of such abnormality signals are generated, a weaving operation of the loom 7 is stopped, and therefore the abnormality signals are referred to as loom stop signals. Additionally, a loom stop time for which a weaving operation of the loom 7 is being stopped is judged or forecasted in accordance with the type of the abnormality signal, by a loom stop time judging device 8. The loom stop time is a forecasted repairing time required for a repairing or restoring operation and between a first time at which the loom weaving operation stops and a second time at which the loom weaving operation restarts. A signal representative of the judged loom stop time is output to a comparator 9 which is adapted to compare the judged loom stop time with a predetermined time corresponding to the maximum permissible time for which any defect in the woven cloth (such as filling bar) has not yet been formed. In case that the judged loom stop time is longer than the predetermined time, the comparator 9 outputs a signal representing this fact to the controller 10. Then, the controller 10 outputs a leveling motion operating signal L, so that a leveling motion 4 is operated to level the warp yarns 1 generally at a warp line (a level or plane connecting the cloth fell CF and the top surface of a back roller B) through the shedding motion 3. As a result, the tension of the warp yarns is loosened to prevent the warp yarns from being unduly stretched.

In case that the judged loom stop time is equal to or shorter than the predetermined time, the comparator 9 outputs a signal representing this fact to the controller 10. Then, the controller 10 outputs an abnormality recovering signal M for operating the automatic abnormality recovering device 6 while making the leveling motion 4 inoperative, thereby normalizing the weaving operation of the loom 7. It will be understood that the loom stop time judging device 8, the comparator 9 the controller 10 and the like constitute a control unit U such as a microcomputer.

Figure 2:
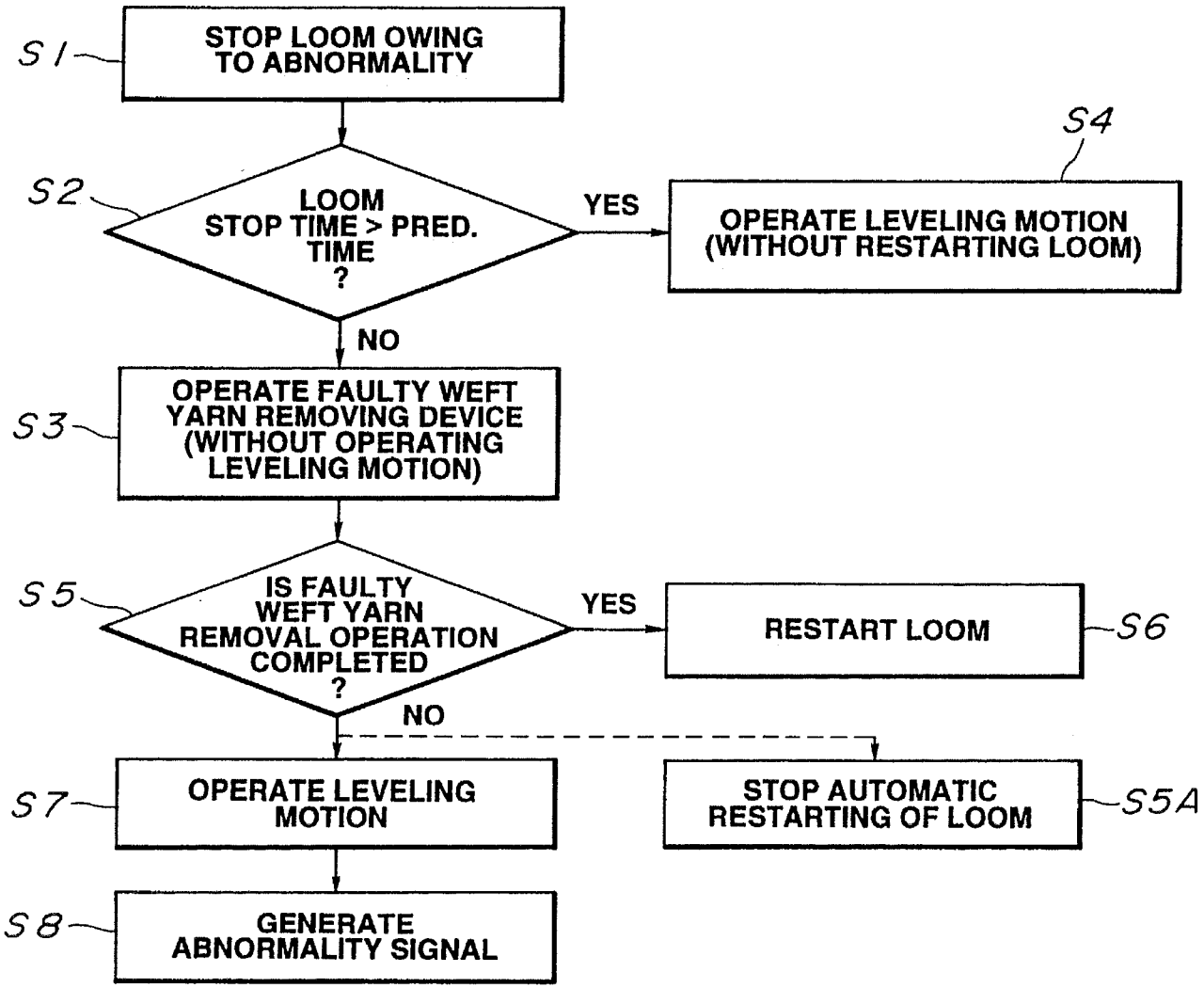
FIG. 2 is a flowchart showing an example of operation of the loom of FIG. 1.

The manner of operation of the above loom 7 will be discussed with reference to a flowchart of FIG. 2 and also to FIG. 1.

In the event that the weft picking failure signal is generated, first the weaving operation of the loom 7 is stopped at a step S1. Then, at a step S2, a judgment or forecasting is made as to whether the repairing time or loom stopping time will be longer than the predetermined time, in accordance with the type (the weft picking failure signal) of the abnormality signal. This judgment is made by the loom stop time judging device 8. In this regard, restarting of the weaving operation of the loom 7 is possible within the predetermined time upon operating the automatic faulty weft yarn removing device 6, thereby making a judgment that the loom stopping time is not longer than the predetermined time. This judgment is made by the comparator 9. Next at step S3 the faulty weft yarn removing device 6 is operated to remove the faulty weft yarn from the path of the weft yarn, in which the leveling motion 4 is not operated. At a step S5, a judgment is made as to whether the removal operation for the faulty weft yarn has completed or not from the weft yarn path (for example, the shed of warp yarns) upon direct or indirect detection of a detector (not shown), prior to an automatic restarting of the loom 7.

In case that the faulty weft yarn removal operation has been completed, in step S6, the weaving operation of the loom 7 is automatically restarted. In case that the removal operation has not been completed, in step S7 the leveling motion 4 is operated thereby leveling the warp yarns 1. More specifically, in response to a signal representing that the faulty weft yarn removal operation has not been completed, the loom stopping time judging device 8 outputs a signal representative of the loom stopping time corresponding to such a situation to the comparator 9. Upon input of this signal, the comparator 9 makes such a judgment that the forecasted loom stopping time or repairing time is longer than the predetermined time and therefore causes the controller 10 to output the leveling motion operating signal L thus to operate the leveling motion 4. Otherwise, in response to the signal representing that the faulty weft yarn removal operation has not been completed, an automatic loom restarting stop signal may be generated to stop an automatic restarting of the loom weaving operation at a step S5A. At a step S8, an abnormality signal is generated to inform an operator that an abnormal condition is made.

In the event that the loom weaving operation is stopped by a cause such as breakage of the warp yarn, the selvage yarn or the trimmed selvage yarn which requires a considerably long time to be repaired or restored, the warp yarn breakage signal, selvage yarn breakage signal or the weft end treatment yarn breakage signal is generated, thereby making a judgment that the loom stopping time is longer than the predetermined time at the step S2. This judgment is made by the stop time judging device 8. Then, the comparator 9 outputs the signal representative of this fact to the controller 10, so that the controller 10 outputs the abnormality recovering signal M to the automatic abnormality recovering device 6. Next in step S4, the leveling motion 4 is operated thereby leveling the warp yarns 1. As a result, a tension applied to the warp yarns 1 is softened.

As discussed above, according to the loom of the present invention, in the event of the loom weaving operation stopping due to the weft picking failure or mispick, first, the automatic faulty weft yarn removing device 6 is operated to automatically remove the faulty weft yarn. In case that the removal of the faulty weft yarn has been completed, the weaving operation of the loom is automatically restarted thereby obtaining a high operational efficiency of the loom without causing a filling bar in the woven cloth. Otherwise, in case that the removal of the faulty weft yarn has not been completed, leveling the warp yarns is made thereby preventing the formation of a filling bar owing to the loom weaving operation restarting after a long time stopping of the weaving operation. It is to be noted that the loom is reversely run in case that the faulty weft yarn removing device 6 is operated, the location of the cloth fell CF is shifted so that the tension of the warp yarns is changed. In order to effectively prevent formation of a filling bar under such a situation, it is preferable that a leveling position at which the warp yarns are leveled is different from that under the warp yarn breakage or the like.

Next, an example of the shedding motion 3 and the leveling motion 4 used in the loom 7 of the present invention will be discussed with reference to FIGS. 3 to 7. In this example, the shedding motion 3 is of the cam-operated type wherein healds 11 are moved under the action of shedding cams 63.

The shedding motion 3 includes a first gear 61 which is rotated in time relation to the weaving operation of the loom by a driving device including a main shaft (not shown) of the loom 7. The first gear 61 is in mesh with a second gear 62 so that the second gear 62 is rotated by the first gear 61 thereby causing the shedding cams 63 to rotate. The shedding cams 63 are fixedly mounted on a center shaft 14 of the second gear 62 and coaxially fixed with each other. The shedding cams 63 include a pair of combination cams 64, 65 which are coaxial with the second gear center shaft 14. Rollers 67, 68 as cam followers are contactable respectively to the shedding cams 65, 64, and are rotatably attached to a cam lever 66. Accordingly, the cam lever 66 is adapted to be driven through the rollers 67, 68 by the cams 64, 65 so as to be swingable around its pivot shaft 69 thereby making its swinging movement. This swinging movement is transmitted to the frame of the heald 11 (in FIG. 1) through a linkage including a connecting rod 60, an intermediate curved lever 71, a suspension lever (not shown) and a bent rod (not shown). Accordingly, the heald frame makes its vertical stroke movements thereby forming the shed S of the warp yarns 1. The pivot shaft 69 extends between a pair of drums 12 and eccentrically fixed at its opposite ends to the drums 12. The drums 12 are rotatably supported respectively to a pair of oppositely disposed support plates 21, 21 fixed to a frame 13 forming Dare of the loom 7, in which each drum 12 is fixable at a predetermined rotational position. One of the drums 12 is provided with a rotatable shaft 12*a* which extends laterally and projects outside of the frame 13. The rotatable shaft 12*a* is integral and coaxial with the drum 12.

Figure 5:
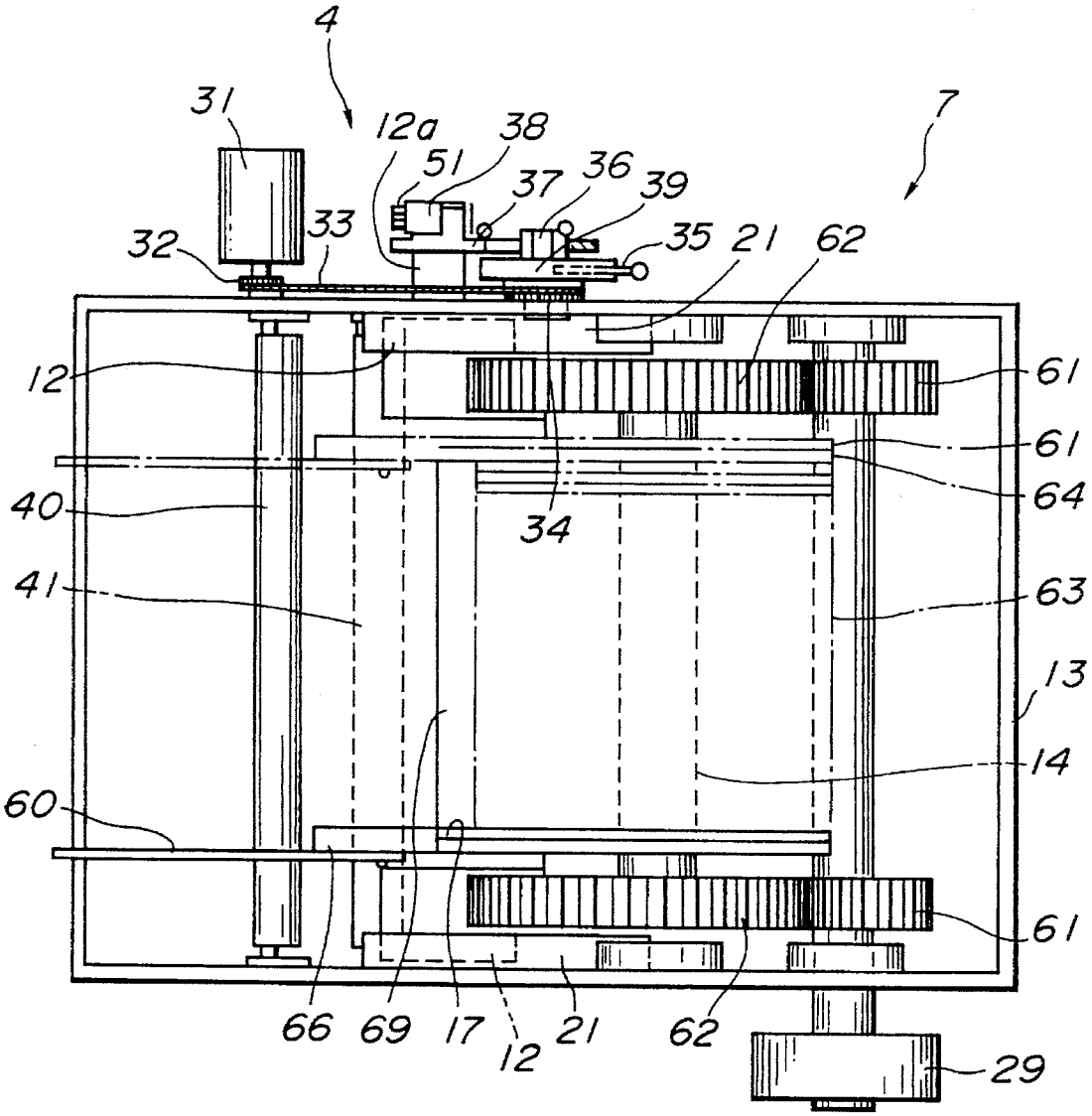
FIG. 5 is a plan view of an essential part of the cam-operated type shedding motion of FIG. 3.
Figure 6:
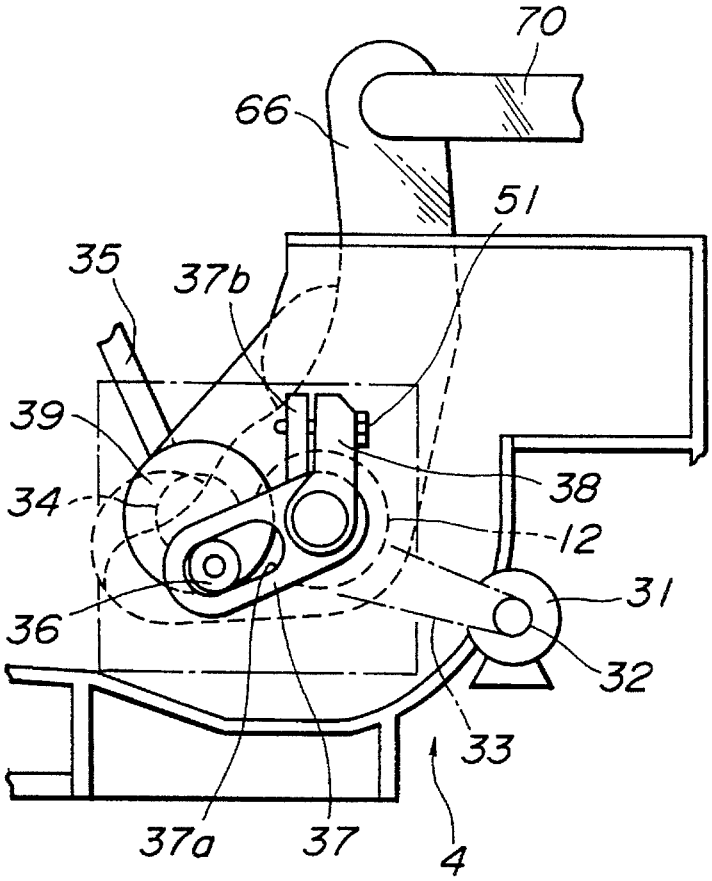
FIG. 6 is a side elevation of an essetial part of a leveling motion incorporated with the shedding motion of FIG. 3.

As shown in FIGS. 5 and 6, the leveling motion 4 includes a motor 31 which is disposed outside of the frame 13 and located together with the rotatable shaft 12*a* at the same side of the frame 13. The motor 31 is provided with a sprocket 32. A rotatable disc 39 is rotatably supported to the frame 13 and provided with a sprocket 34. A chain 33 is passed on the sprockets 32, 34 so that the sprocket 34 is driven by the sprocket 32. A drum shaft lever 38 is fixedly mounted at its one end portion on the rotatable shaft 12*a*. A toggle lever 37 is rotatably mounted at its one end portion on the rotatable shaft 12*a*. The toggle lever 37 is formed at the one end portion with an upwardly extending section 37*b* which is adjustably joined with the drum shaft lever 38 by a screw 51. Additionally, the toggle lever 37 is formed at the other end portion with an elongate slot 37*a* which extends to a position near the longitudinal center of the toggle lever 37. A roller 36 is rotatably fitted within the slot 37*a* of the toggle lever 37 and pivotally and eccentrically fixed to the rotatable disc 39, so that the roller 36 is slidably movable within the slot 37*a* along the length of the toggle lever 37.

Figure 8:
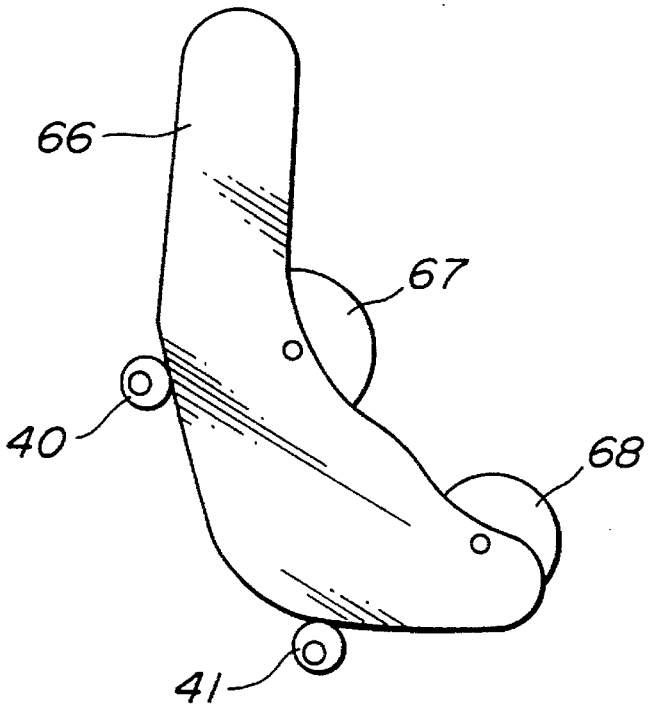
FIG. 8 is a side view of an essential part of the shedding motion of FIG. 3.
Figure 9:
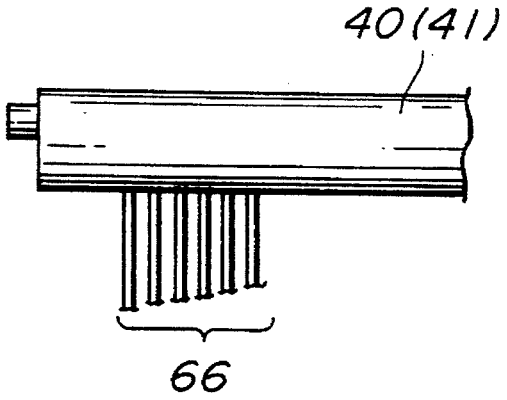
FIG. 9 is a fragmentary plan view of an essential part of the leveling motion of FIG. 3.

As clearly shown in FIGS. 8 and 9, a pair of abutting rods 40, 41 are disposed extending parallel with the pivot shaft 69 and rotatably supported at their opposite end portions to the opposite side sections of the frame 13. Each abutting rod 40, 41 is rotatable around a longitudinal axis (not shown) which is eccentric relative to the abutting rod 40, 41. These abutting rods 40, 41 function to restrict a moving range of the cam lever 66 in horizontal and vertical directions. The reference numeral 29 in FIG. 5 designates a pulley through which a rotational force is supplied from the main shaft of the loom 7. Additionally, the reference numeral 35 in FIGS. 5 and 6 designates a lever through which the rotatable disc 39 can be manually rotated.

With the arrangement of FIGS. 3 to 9, when the rotatable disc 39 is rotated through the chain 33 by the motor 31 in response to the leveling motion operating signal L from the controller 10 in FIG. 1, the toggle lever 37 is turned through the roller 36 which is eccentrically mounted on the rotatable disc 39. As a result, the rotatable shaft 12*a* and accordingly the drum 12 are rotated through the drum shaft lever 38 joined to the toggle lever extending section 37*b*, so that the pivot shaft 69 is moved from its state shown in FIG. 4 to its state shown in FIG. 3. Consequently, the rollers 67, 68 are separated from the cams 64, 65. Under this condition, the toggle lever 37 is in a state indicated in phantom in FIG. 7.

Figure 4:
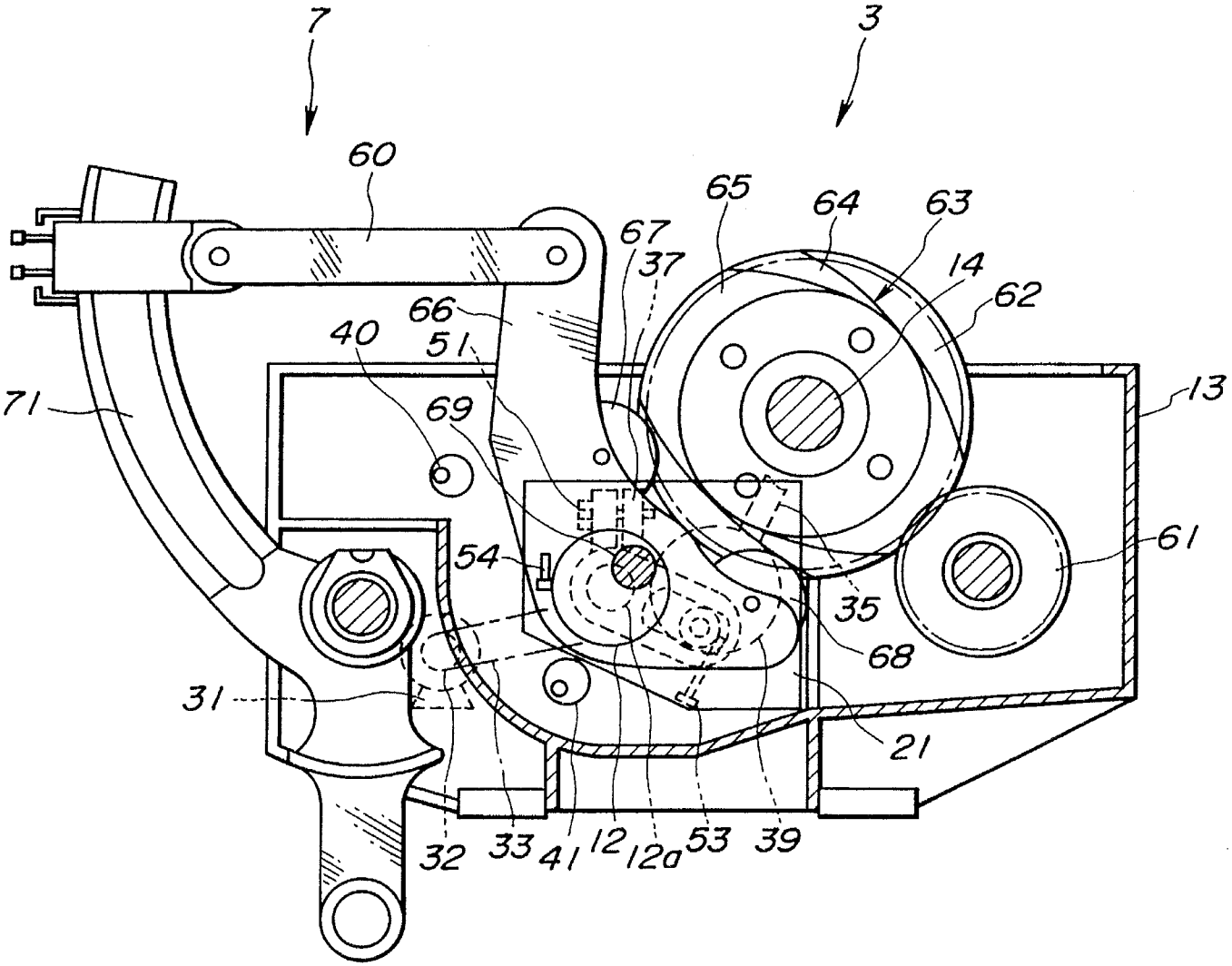
FIG. 4 is a side elevation similar to FIG. 3, but showing another operational mode.
Figure 7:
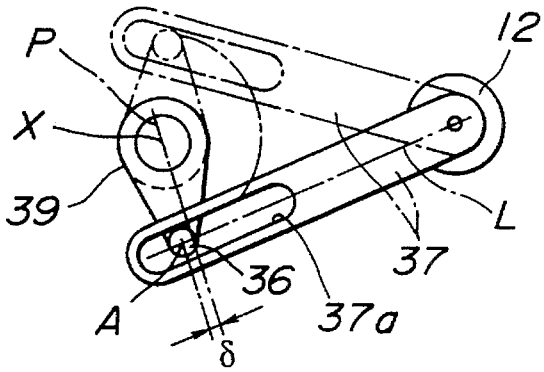
FIG. 7 is a side view of an essential part of the leveling motion of FIG. 6, illustrating a locking function of the leveling motion.

During a normal weaving operation of the loom 7, the toggle lever 37 is rotated by the motor 31 similarly to the above so as to be put into a state indicated by solid lines in FIG. 7. Under this state, as shown in FIG. 7, the roller 36 is such positioned relative to the toggle lever 37 that the axis A of the roller 36 is positioned separate from and outside of an imaginary plane P containing the axis X of the rotatable disc 39 and perpendicular to the longitudinal axis L of the toggle lever 37. In other words, the axis A resides between the imaginary plane P and the extreme end of the end portion having the slot 37*a*. Thus, under the state shown in FIG. 7, the roller 36 is brought into a position slightly near the extreme end of the toggle lever end portion having the slot 37*a* and over a dead point corresponding to the plane P by a distance δ as indicated in FIG. 7. This configuration can prevent the drum 12 from being rotated, through the toggle lever 37. By such arranging that the rollers 67, 68 of the cam lever 66 are brought into contact with the cams 65, 64 under the state indicated by the solid lines in FIG. 7, the rollers 67, 68 can be securely kept in position contacting with the cams without any locking device or member (not shown). This state is shown in FIGS. 4 and 6.

Figure 3:
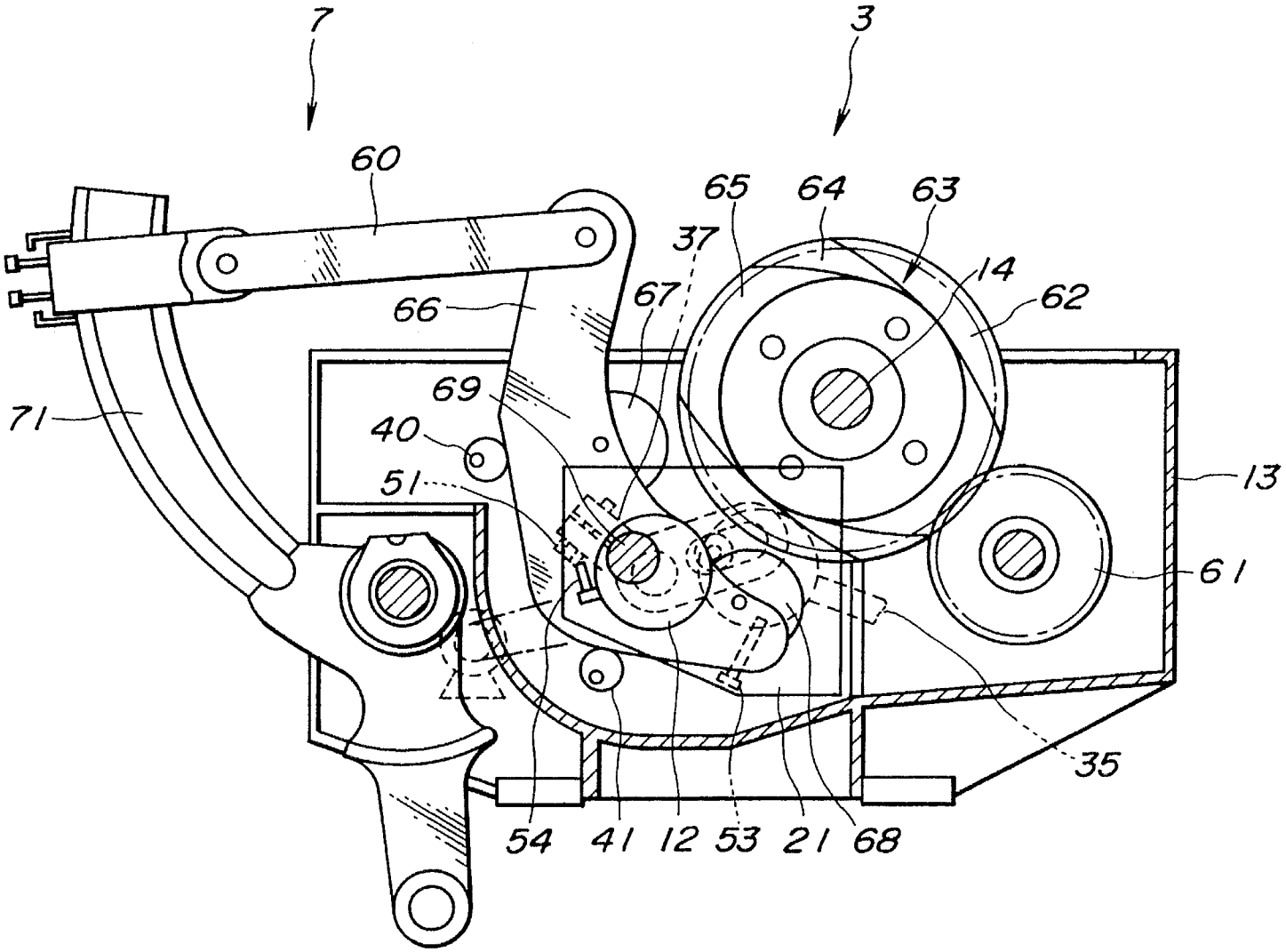
FIG. 3 is a side elevation of an essential part of a cam-operated type shedding motion forming part of the loom of FIG. 1, showing an operational mode.

Under a condition the rollers 67, 68 of the cam lever 66 are being separate from the cams 65, 64 as shown in FIG. 3, the cam lever 66 is brought into contact with the abutting rods 40, 41 by rotating the drum 12 thereby accomplishing the positioning of the cam lever 66. In this regard, the position of the thus positioned cam lever 66 can be shifted by rotating the abutting rods 40, 41 each of which is eccentrically supported to the frame 13. Accordingly, by virtue of the abutting rods 40, 41, all the warp yarns can be leveled at a level separate by a predetermined distance from the warp line, thereby equalizing a tension applied to all the warp yarns during stopping of the loom with that during weaving operation of the loom. Similarly, it will be appreciated that the above arrangement of the abutting rods 40, 41 can equalize a total tension applied to the warp yarns upon being leveled with that at a time the loom weaving operation is stopped. This can effectively prevent a so-called temple bar from being formed in the woven cloth.

What is claimed is:

1. A loom comprising:

a shedding motion;

a leveling motion incorporated with the shedding motion, for leveling warp yarns, when said leveling motion is operated;

means for generating a plurality of types of loom stop signals to stop a weaving operation of the loom based on different types of predetermined reasons for stopping the loom;

means for operating said leveling motion in response to one of said loom stop signals;

means for judging that a loom stop time is longer or shorter than a predetermined time in accordance with the type of said loom stop signals, said loom stop time being equal to a time duration between a first time at which the loom weaving operation is stopped and a second time at which the loom weaving operation is restarted; and means for operating said leveling motion in response to a judgment of said judging means that said loom stop time is longer than said predetermined time.

2. A loom as claimed in claim 1, wherein said loom stop signal generating means includes means for generating a weft picking failure signal when a weft picking fails, wherein said loom further comprises means for removing a faulty weft yarn from a path of a weft yarn in the loom, when said means for removing the faulty weft yarn is operated, and means for operating said faulty weft yarn removing means in response to said weft picking failure signal, wherein said judging means includes means for judging that said loom stop time is shorter than said predetermined time, in accordance with said weft picking failure signal, wherein said loom further comprises means for making said leveling motion inoperative in response to a judgment of said judging means that said loom stop time is shorter than said predetermined time.

3. A loom as claimed in claim 2, further comprising means for detecting incompletion in operation of said faulty weft yarn removing means, wherein said judging means includes means for judging that said loom slop time is longer than said predetermined time in response to the detected incompletion in operation of said faulty weft yarn removing device.

4. A loom as claimed in claim 3, further comprising means for generating a signal for stopping an automatic restarting of the loom weaving operation in response to the detected incompletion in operation of said faulty weft yarn removing device, wherein said judging means includes means for judging that said loom stop time is longer than said predetermined time in response to said automatic restarting stopping signal.

5. A loom as claimed in claim 1, wherein said leveling motion includes means for leveling warp yarns at a position separate by a predetermined distance from a ward line to equalize a total tension applied to the warp yarns upon being leveled at a time the loom weaving operation is stopped.

6. A loom as claimed in claim 1, wherein the shedding motion is of a cam-operated type.

7. A loom as claimed in claim 6, wherein said shedding motion includes first and second cams adapted to be rotatable in timed relation to the loom weaving operation, a cam lever rotatably mounted on a pivot shaft, first and second cam followers which are rotatably attached to said cam lever and contactable respectively with the first and second cams, a heald through which the warp yarns pass, a linkage connecting said cam lever and said heald.

8. A loom as claimed in claim 7, wherein said shedding motion includes means for shifting a position of said pivot shaft to separate the first and second cam followers from said first and second cams.

9. A loom as claimed in claim 8, wherein said leveling motion further includes means for controllably restricting a movement of said cam lever in a direction away from said first and second cams.

10. A loom as claimed in claim 1, wherein said predetermined time is equal to a time in which the warp yarns are prevented from forming a defect in a woven cloth.

* * * * *